US007506975B2

(12) United States Patent
Cellura et al.

(10) Patent No.: US 7,506,975 B2
(45) Date of Patent: Mar. 24, 2009

(54) STICKY BAFFLE

(75) Inventors: Mark A. Cellura, Webster, NY (US); Antonio St. C.L. Williams, Wilsonville, OR (US); Richard P. Germain, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 445 days.

(21) Appl. No.: 11/167,133

(22) Filed: Jun. 28, 2005

(65) Prior Publication Data

US 2006/0290761 A1 Dec. 28, 2006

(51) Int. Cl.
*B41J 2/01* (2006.01)

(52) U.S. Cl. ..... 347/103; 347/25; 347/30; 347/55; 347/102; 347/104; 399/98; 399/323

(58) Field of Classification Search ..... None
See application file for complete search history.

(56) References Cited

U.S. PATENT DOCUMENTS 5,365,261 A * 11/1994 Ozawa et al. ..... 347/103
5,389,958 A 2/1995 Bui et al.
5,677,718 A 10/1997 Crawford et al.
5,805,191 A * 9/1998 Jones et al. ..... 347/103
6,164,752 A 12/2000 Schaefer et al.
6,308,024 B1 10/2001 Nakayama et al.
6,328,442 B1 * 12/2001 Brinkly ..... 347/104
6,494,570 B1 12/2002 Snyder
6,782,228 B1 8/2004 Rasch et al.
7,128,412 B2 * 10/2006 King et al. ..... 347/103
7,182,454 B2 * 2/2007 Nakazawa ..... 347/102
7,384,122 B2 * 6/2008 Shimizu ..... 347/34

* cited by examiner

*Primary Examiner*—Luu Matthew
*Assistant Examiner*—John P Zimmermann
(74) *Attorney, Agent, or Firm*—Pillsbury Winthrop Shaw Pittman LLP

(57) ABSTRACT

A printing medium baffle for protecting printheads printing on an image transfer member from particulates associated with the printing medium. The baffle may have one or more adhesive surfaces.

10 Claims, 4 Drawing Sheets

FIG. 1 (PRIOR ART)
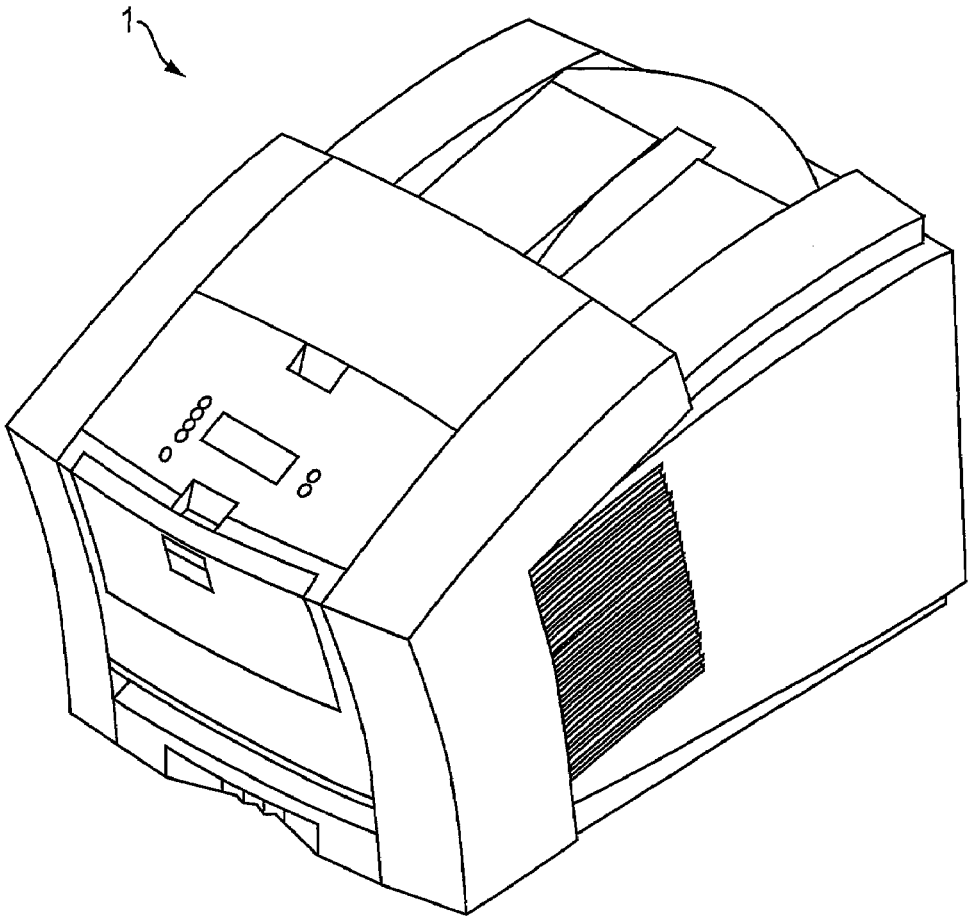
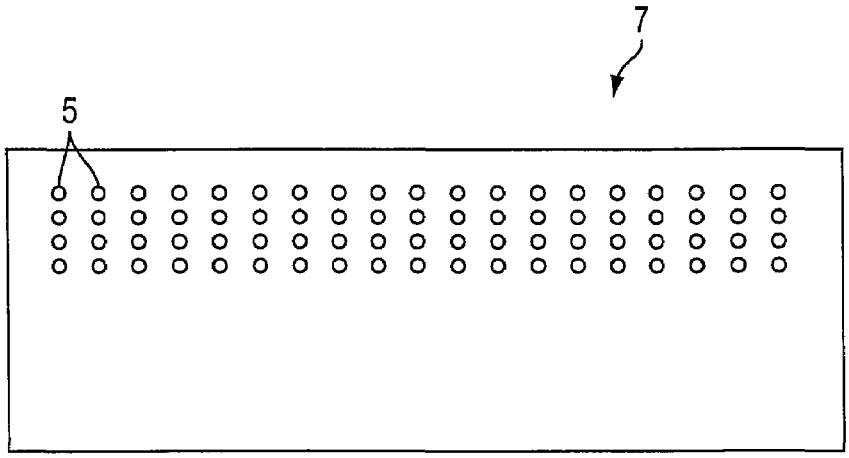
FIG. 2 (PRIOR ART)

STICKY BAFFLE

BACKGROUND

All references cited in this specification, and their references, are incorporated by reference herein where appropriate for teachings of additional or alternative details, features, and/or technical background.

Disclosed in the embodiments herein is a system for protecting the face of a printhead, in particular a solid ink jet printhead printing on an image transfer member, from contaminants. Such system comprises a sticky baffle placed in close proximity to the surface of an image transfer surface superior to the printhead.

For printing in a solid-ink printer, the simplest method of producing an output image is to propel droplets of ink onto a piece of paper to directly print the image onto the paper, i.e., a process known as direct printing. However, direct printing has many disadvantages. First, the head to paper gap must be adjusted for different media in order to control drop position. Second, there is the well-known paper hand-off problem between the rollers that guide the paper, because of the large size of the head. Third, there is a concern that head reliability will decrease because the paper is near the head. Also, to maximize print speed, many direct print architectures deposit the image bi-directional, which introduces image artifacts and color shifts. These problems are addressed with an offset, or indirect printing process. In this process, the ink is first applied to a rotating drum or other intermediate support surface and then transfixed off onto the paper wherein the ink goes on hot and then is fused. Therefore, a single drum surface transfers the image, spreads the ink droplets, penetrates the ink into the media, and controls the topography of the ink to increase paper gloss and transparency haze.

The process requires a delicate balance of drum temperature, paper temperature, transfix load, drum and transfix roller materials and properties thereof in order to achieve image quality.

To solve some of the above stated problems, ink jet printing systems have utilized intermediate transfer ink jet recording methods, such as that disclosed in U.S. Pat. No. 5,389,958. The intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred to the final receiving substrate.

FIG. 1 (prior art) is an overall perspective view of an offset phase change ink jet printing apparatus, generally indicated by the reference numeral 1. An example of an offset phase change ink jet printer is disclosed in U.S. Pat. No. 5,389,958.

FIG. 3 (prior art) illustrates the inner works of solid ink jet systems that may be employed in the housing shown in FIG. 1 employing an image transfer drum.

Referring to FIG. 3, there is shown a print head 11 having ink jets supported by appropriate housing and support elements (not shown) for either stationary or moving utilization to deposit ink droplets in image configuration onto an intermediate transfer surface 12.

For hot melt or solid ink based systems, the ink utilized is preferably initially in solid form and then changed to a molten state by the application of heat energy to raise the temperature from about 85 degrees to about 150 degrees centigrade. In various embodiments, the temperature may be lower or higher, but this range is preferred. Elevated temperatures above this range may cause degradation or chemical breakdown of inks currently in use. The molten ink is then applied in raster fashion from ink jets in the print head 11 to the intermediate transfer surface 12 forming an ink image. The ink image is then cooled to an intermediate temperature and solidifies to a malleable state wherein it is transferred to a receiving substrate 28 such that the pixels are not spread and an initial matte finish is achieved.

The intermediate transfer surface 12 may be provided in the form of a drum, as shown in FIG. 3, but may also be provided as a web, platen, belt, band or any other suitable design. The drum 14 may be fabricated out of any metallic material and most preferably is made from aluminum and polished to a high gloss. The intermediate transfer surface may also be coated with an elastomer layer 8, which defines a release surface. In addition, the intermediate transfer surface 12 may be coated with a liquid release layer applied to the drum 14 by contact with an applicator assembly 16, such as a liquid impregnated web, wicking pad, roller or the like. By way of example, but not of limitation, applicator assembly 16 comprises a wicking roller or pad of fabric or other material impregnated with a release liquid for applying the liquid and a metering blade 18 for consistently metering the liquid on the surface of the drum 14. Suitable release liquids that may be employed to coat the intermediate transfer surface 12 include water, fluorinated oils, glycol, surfactants, mineral oil, silicone oil, functional oils or combinations thereof. As the drum 14 rotates about a journalled shaft in the direction shown in FIG. 3, applicator assembly 16 is raised by the action of an applicator assembly cam and cam follower (not shown) until the wicking roller or pad is in contact with the surface of the drum 14. The release liquid, retained within the wicking roller or pad is then deposited on the surface of the drum 14.

The intermediate transfer surface 12 may be heated by an appropriate heater device 19. The heater device 19 may be a radiant resistance heater positioned as shown or positioned internally within the drum 14. In a preferred embodiment incorporating solid ink based ink jet technology, the heater device 19 may increase the temperature of the intermediate transfer surface 12 from ambient temperature to between 25 degrees to about 70 degrees centigrade or higher for receiving the ink from print head 11. This temperature is dependent upon the exact nature of the liquid employed in the intermediate transfer surface 12 and the ink used and can be adjusted by providing an optimal temperature controller 40 in combination with a thermistor 42. Ink is then applied in molten form from, for example, about 85 degrees to about 150 degrees centigrade to the exposed surface of the intermediate transfer surface 12 by the print head 11 forming an ink image 26. The ink image 26 solidifies on the intermediate transfer surface 12 by cooling down to the malleable intermediate state temperature provided by heating device 19.

After the ink image is created on the intermediate transfer surface, the image is then transferred to a receiving substrate 28. A receiving substrate guide apparatus 20 may transport the receiving substrate 28, such as paper or transparency, from a positive feed device (not shown) and guides it through a nip 29 formed between drum 14 and transfer roller 23. Thus, opposing arcuate surfaces of the transfer roller 23 and the drum 14 forms the nip 29. The transfer roller 23 may have a metallic core, preferably steel with an elastomer coating 22. The drum 14 continues to rotate, entering the nip 29 formed by the transfer roller 23 with the curved surface of the intermediate transfer surface 12 containing the ink image 26. The ink image 26 is then deformed to its image conformation and transferred to the receiving substrate 28 such that the pixels formed by the ink image on the receiving substrate are not spread creating an initial matte finish. The elastomer coating 22 on roller 23 engages the receiving substrate 28 on the reverse side to which the ink image 26 is transferred.

In this process, the ink image 26 is first applied to the intermediate transfer surface 12 of the rotating drum 14 and then transfixed off onto the receiving substrate 28 having a pixel image. Stripper fingers 25 (only one of which is shown) may be pivotally mounted to the imaging apparatus 10 to assist in removing any paper or other final receiving substrate 28 from the exposed surface of the intermediate transfer surface 12.

Heater 21 may be used to preheat the receiving substrate 28 prior to the transfer of the ink image 26. The thermal energy of the receiving substrate 28 is preferably kept sufficiently low so as not to melt the ink image upon transfer to the receiving substrate 28. When the ink image 26 enters the nip 29 it is deformed to its image conformation and adheres to the receiving substrate 28 either by the pressure exerted against ink image 26 on the receiving substrate 28 or by the combination of the pressure and heat supplied by heater 21 and/or heater 19. Heater 24 may be employed which heats the transfer roller 23. Heater devices may also be employed in the paper or receiving substrate guide apparatus 20 and/or in the transfer and fixing roller 23, respectively. The pressure exerted on the ink image 26 must be sufficient to have the ink image 26 transfer to the receiving substrate 28.

A general problem in ink jet printers printing on an image transfer member, in particular solid ink jet printers or so-called phase change ink jet printers, is that the paper in its movement through the printer may introduce paper particle contamination into the inner machine environment where such contamination may reach the nozzle faces of the printheads, causing temporary or permanent jet deflections or outages. FIG. 2 (prior art) shows a front plan view of an orifice plate 7 that forms part of an ink jet print head (not shown). An example of a suitable ink jet print head is found in U.S. Pat. No. 5,677,718. The orifice plate 7 includes multiple rows of multiple orifices 5. The print head ejects ink from orifices 5 to create an image on an intermediate transfer surface (not shown), such as silicone oil. The image is then transferred to a final receiving medium, such as a sheet of paper. There is needed a low cost contamination abatement system which traps contaminants before they can reach the printhead.

REFERENCES

U.S. Pat. No. 5,389,958, commonly assigned, discloses a method and the apparatus for employing the method whereby an intermediate transfer surface of a layer of sacrificial liquid is applied to a supporting surface and a phase change ink is deposited on the liquid layer. The inked image is then transferred to a final receiving substrate.

U.S. Pat. No. 6,164,752, commonly assigned, discloses a method for purging an ink jet print head to clear ink jet orifices is provided. A purge cap forms a vacuum seal over the orifice plate of the print head. Multiple low pressure differential vacuum pulses are applied to the purge cap to remove debris and trapped air bubbles from the ink jet orifices. The low pressure pulses avoid cavitation inside the print head and reduce the amount of ink expelled during the purging process.

SUMMARY

Aspects disclosed herein include:

a baffle for use in a printer to protect a printhead printing on an image transfer member which then transfers the printing to a printing medium from particulates associated with the printing medium, the baffle comprising a structure configured to be positioned within the printer below the printing medium and above the printhead, and having a first adhesive surface facing generally toward the printing medium when positioned in the printer;

an ink jet printer comprising a baffle having a first adhesive surface, the baffle being positioned below the printing medium and above the printhead with the first adhesive surface facing generally toward the printing medium; and a method for protecting an ink jet printhead in a printer utilizing an image transfer member to transfer the image onto substrate feed in a substrate path positioned superior to the ink jet printhead, the method comprising positioning a baffle having a first adhesive surface below the printing medium and above the printhead with the first adhesive surface facing generally toward the printing medium.

BRIEF DESCRIPTION OF THE DRAWINGS

Various of the above mentioned and further features and advantages will be better understood from this description of embodiments thereof, including the attached drawing figures wherein:

FIG. 1 shows a prior art ink jet printer in overall perspective view;

FIG. 2 shows a prior art orifice plate in an ink jet printhead in front plan view;

DETAILED DESCRIPTION

Figure 3:
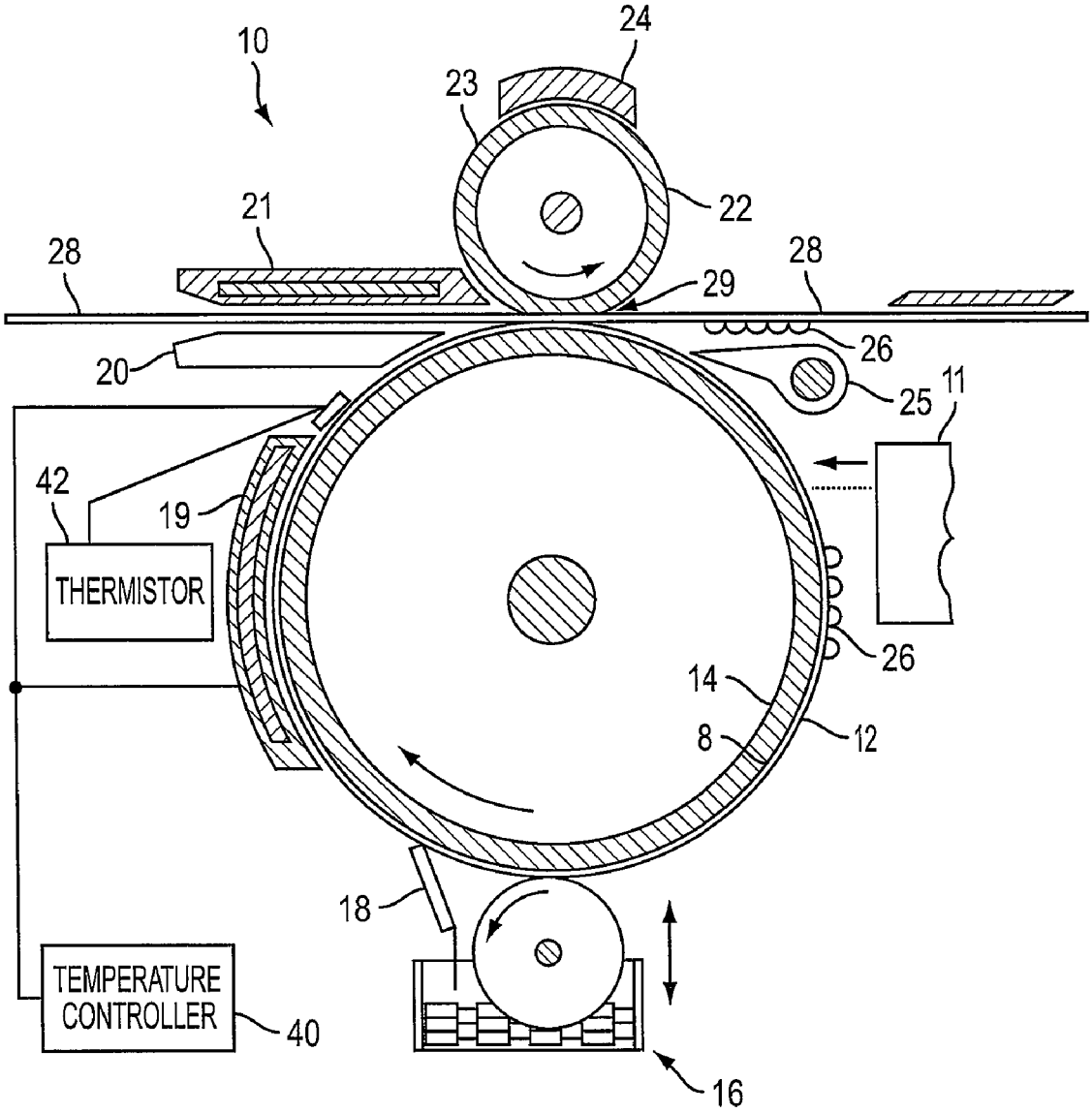
FIG. 3 (PRIOR ART)
FIG. 3 shows a prior art cross-sectional diagrammatic illustration of an ink jet printer designed to print on an intermediate transfer member.

In embodiments, there is disclosed printing medium baffle for protecting printheads printing on an image transfer member from particulates associated with the printing medium, the baffle comprising a structure configured to be positioned within a printer inferior to (i.e., below) the printing medium and superior (i.e., above) to the printhead, and having a first adhesive surface lying over the printhead when positioned in the printer.

In such embodiment, the structure may further comprise a second adhesive surface in close proximity to the image transfer member. The first and second adhesive surfaces may be different or the same, on the same side, or opposite one another. The structure may contain two surfaces angles with respect to each other. Such baffle embodiment may be used in an inkjet printer that may employ an image drum, or movable image transfer member such as an image web, for example, an image belt. The baffle may be generally positioned to be capable of trapping stray printing substitute particles and/or particles expelled or extending from a moving image transfer member.

In one embodiment, there is provided a stiff baffle placed in proximity to the surface of an intermediate transfer drum. The baffle is positioned so as to have an adhesive surface exposed below the paper or other substrate path running above the intermediate transfer drum. The top adhesive surface is positioned to shield the drum from particles raining down from above by capturing those particles as the paper or other substrate passes above the drum. The baffle may also have an adhesive surface positioned to capture particles traveling in the boundary layer around the drum when the drum is spinning and to capture any long fibers, etc., that may extend from the drum and contact the baffle.

In one embodiment, the baffle comprises a metal or plastic stock having adhesive applied to at least one surface. Adhesives remaining sticky or adherable over prolonged periods of time are usefully employed. For example, as found with double-sided sticky tape from Tel Pella, Inc.

As the abatement effect of such baffle system will decrease over time, in particular as the tacky collection surface becomes saturated with contaminants, it would be useful if the baffle contamination abatement system were renewable, either by incorporation of the system into a customer replacement unit, such as the drum maintenance cassette (which may be replaced every 10,000 to 30,000 prints), or by configuring the adhesive surface(s) of the baffle to be renewable. Incorporation of all or part of the abatement system into an existing "print process" customer replaceable unit ensures regular replacement. With proper replacement intervals, periodic renewal of the abatement system will prevent the decreased effectiveness associated with a particle-saturated collection surface, extending the initial reliability benefit of abatement throughout the printer's life. If the replacement interval of print-related customer replaceable units is less than the printer's life or the print interval during which the abatement system designates, then the combined customer replaceable unit ensures effective abatement and an associated reliability enhancement throughout the printer's life.

Figure 4:
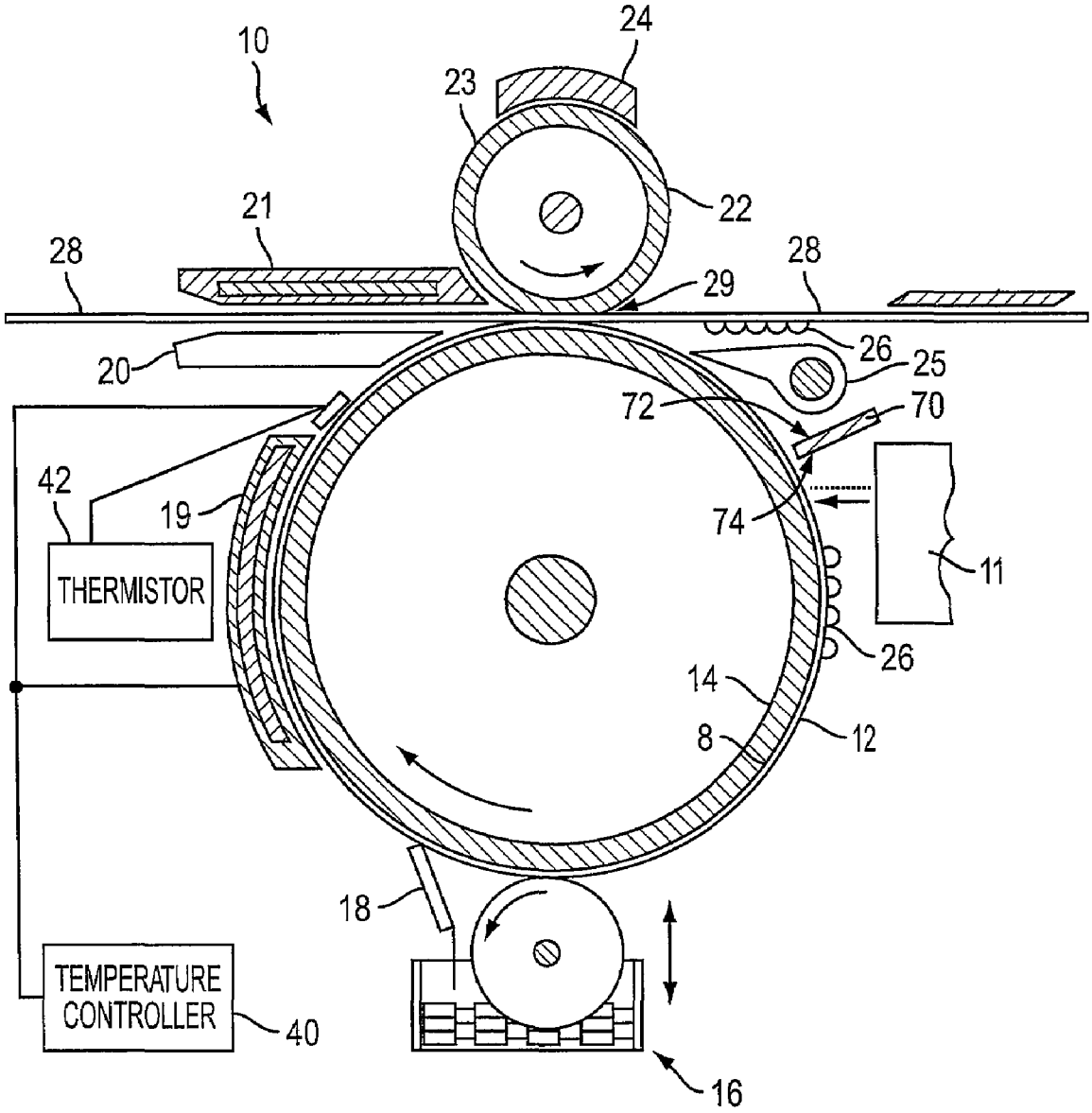
FIG. 4 shows a view similar to FIG. 3, but with a baffle mounted therein.

Now turning to FIG. 4, there is shown a cross-sectional view similar to FIG. 3, but with a baffle 70. Surface 72 of baffle 70 may comprise adhesive material (not shown). The surface 74 generally opposite surface 72 may be devoid of adhesive material. Preferably the baffle 70 and at least its first adhesive surface 72 extend for the entire width (i.e., the direction perpendicular to FIG. 4) of the printing medium (e.g., at least 11 inches for a printer designed to receive 11 inch wide paper). This helps to ensure that material falling from anywhere along the width of the medium may stick to the adhesive on surface 72.

The angles of the surface 72 may be selected such that loose fibers from the printing medium or other such items on the surface of the drum 12 may contact the adhesive surface 72. This facilitates removal such items from the drum 12 upstream of the printhead 11.

Figure 5:
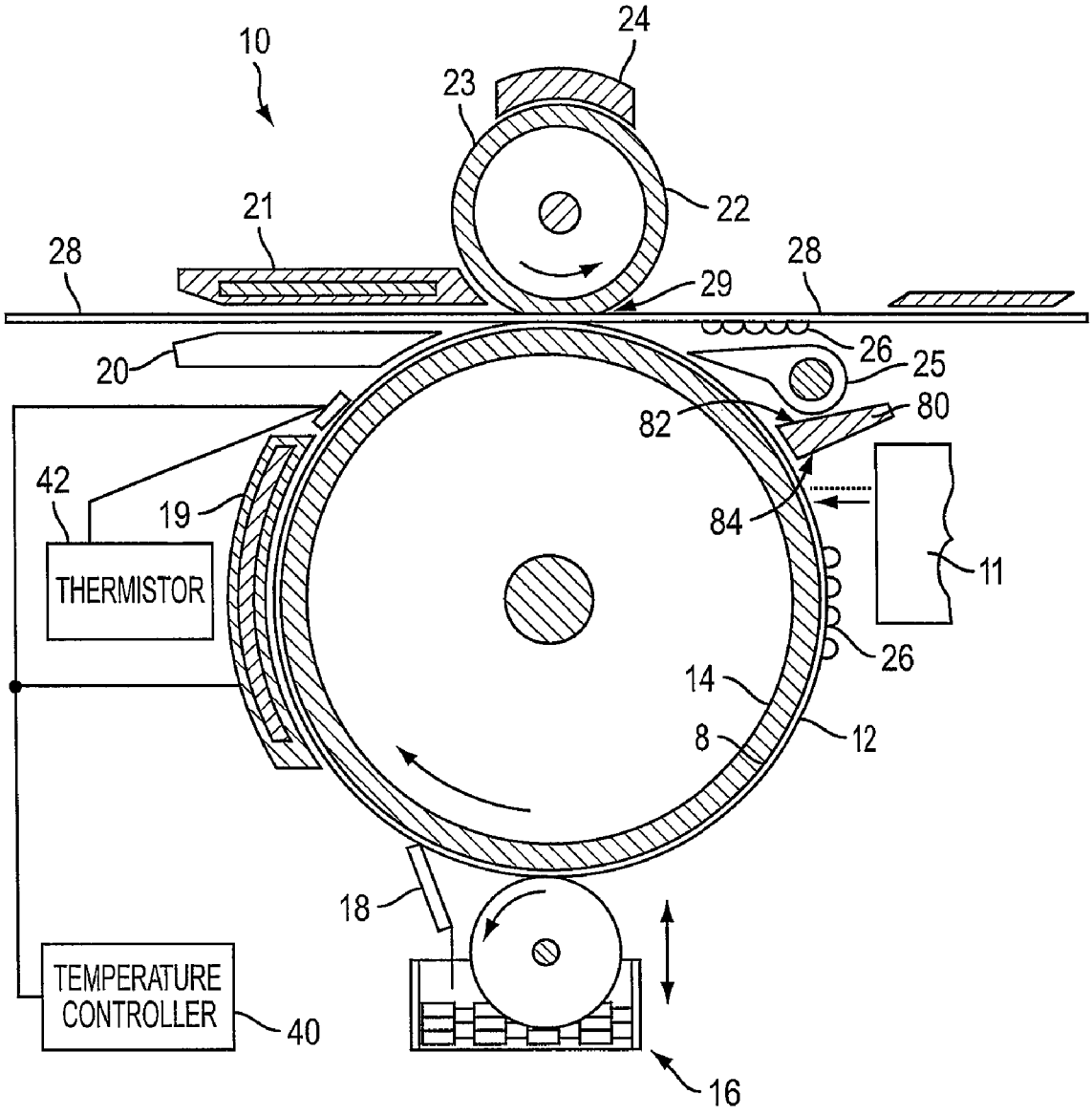
FIG. 5 shows a view similar to FIGS. 3 and 4, but with a different baffle mounted therein.

FIG. 5 shows an alternative arrangement with a differently shaped baffle 80. This baffle 80 has a first adhesive surface 82 similar to surface 72. This surface captures particles falling down from the printing medium 28. Additionally, a second adhesive surface 84 is provided. This second surface has an arcuate shape, is angled with respect to surface 82, and conforms to the outer shape of drum 12. This surface 84 is in close proximity to the drum 12 to allow particles, such as fiber strands from the printing medium 28, to adhere to surface 84 upstream of the printhead 11.

Like baffle 70, baffle 80 and its surfaces 82 and 84 also preferably extend for the entire width of the printing medium 28.

The baffle 70 may be optionally attached to the lower end portion of a upper exit paper guide of the printer. Such an attachment may be made by screws, a snap-fit connection, or by any other suitable means. It could also be attached by integrally forming it as part of the paper guide. However, any other suitable mounting or attachment may be used.

In either embodiment, a gap between the image transfer member (e.g., drum 12) and the baffle 70, 80 may be narrower than a gap between the image transfer member and the printhead 11. This is desirable to prevent particles that could get between the printhead 11 and transfer member from falling downward to the gap between them, as the narrower gap between the baffle 70, 80 and the image transfer member restricts that from happening.

Also disclosed is a method for protecting an ink jet printer forming an image onto a substrate fed in a substrate path positioned above the ink jet printhead, positioning a baffle configured to have at least one adhesive surface such that an adhesive surface of the baffle is positioned below the substrate path and above the ink jet printhead in a manner to allow such adhesive to trap particles of substrate shed in the feed process.

While the invention has been particularly shown and described with reference to particular embodiments, it will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An ink jet printer for printing onto a printing medium comprising:

an ink jet printhead, an image transfer member onto which ink from the ink jet printhead is printed and then transferred to a printing medium in a substrate path passing over said image transfer member, a baffle having a first adhesive surface that includes a sticky substance and is configured to trap particles associated with the printing medium, the baffle being positioned below the printing medium and above the printhead with the first adhesive surface facing generally toward the printing medium.

2. The ink jet printer in accordance with claim 1 wherein the ink jet printhead is a solid ink jet printhead.

3. The inkjet printer in accordance with claim 1 wherein said baffle further is configured, and positioned within said printer, to provide a second adhesive surface in proximity to a surface of the image transfer member.

4. The ink jet printer in accordance with claim 1 wherein the image transfer member is a drum.

5. An ink jet printer in accordance with claim 1 wherein the image transfer member is a web.

6. The ink jet printer in accordance with claim 1 wherein the image transfer member moves in the printing process.

7. The ink jet printer in accordance with claim 3 wherein said second adhesive surface is capable of trapping particles expelled or extending from said moving image transfer member.

8. The ink jet printer in accordance with claim 1 wherein the baffle contains at least two surfaces angled to one another.

9. The ink jet printer in accordance with claim 1, wherein a gap between the image transfer member and the baffle is narrower than a gap between the image transfer member and the printhead.

10. The ink jet printer in accordance with claim 1, wherein the baffle is positioned adjacent to stripper fingers that are configured to assist in removing the printing medium.

* * * * *